US011555258B2

(12) United States Patent
Ferguson et al.

(10) Patent No.: US 11,555,258 B2
(45) Date of Patent: Jan. 17, 2023

(54) COTTON GIN WITH ONE-PIECE GINNING PLATE

(71) Applicant: Monsanto Technology LLC, St. Louis, MO (US)

(72) Inventors: Chris D. Ferguson, St. Louis, MO (US); Matthew J. Link, St. Louis, MO (US)

(73) Assignee: Monsanto Technology LLC, St. Louis, MO (US)

( * ) Notice: Subject to any disclaimer, the term of this patent is extended or adjusted under 35 U.S.C. 154(b) by 314 days.

(21) Appl. No.: 15/684,292

(22) Filed: Aug. 23, 2017

(65) Prior Publication Data

US 2018/0105954 A1 Apr. 19, 2018

Related U.S. Application Data

(60) Provisional application No. 62/409,422, filed on Oct. 18, 2016.

(51) Int. Cl.
*D01B 1/08* (2006.01)

(52) U.S. Cl.
CPC ..... *D01B 1/08* (2013.01)

(58) Field of Classification Search
CPC ..... D01B 1/06; D01B 1/08; D01B 1/04
USPC ..... 19/39, 48 R, 49–64.5
See application file for complete search history.

(56) References Cited

U.S. PATENT DOCUMENTS

| | | | | | |
|---|---|---|---|---|---|
| 20,747 | A * | 6/1858 | Ventress | D01B 1/08 | 19/55 R |
| 116,615 | A * | 7/1871 | Massey | D01B 1/08 | 19/62 R |
| 284,152 | A * | 8/1883 | Williams | D01B 1/08 | 19/62 R |
| 775,349 | A * | 11/1904 | Ellman | D01B 1/08 | 19/61 |
| 2,119,186 | A * | 5/1938 | Streun | D01B 1/08 | 19/56 |
| 3,162,903 | A * | 12/1964 | Wallace | D01B 1/08 | 19/59 |
| 2013/0167327 | A1* | 7/2013 | Lupien | D01B 1/30 | 19/9 |
| 2017/0204535 | A1* | 7/2017 | Owen | D01G 9/20 | |

* cited by examiner

*Primary Examiner* — Khoa D Huynh
*Assistant Examiner* — Aiying Zhao
(74) *Attorney, Agent, or Firm* — Sandberg, Phoenix & von Gotard, P.C.

(57) ABSTRACT

A ginning plate for a crop analytics research cotton gin, wherein the ginning plate comprises a body fabricated. The body includes a front face, a back face, a top end, a bottom end, and opposing sides. The ginning plate additionally comprises a plurality of blade slots extending through the body. Each blade slot comprises an elongated midsection, a mouth disposed at a top of the midsection, and a tail disposed at a bottom of the midsection. The midsection has a first width throughout its length, the mouth has a second width that is greater than the first width, and the tail has a third width that is less than the first width.

11 Claims, 7 Drawing Sheets

COTTON GIN WITH ONE-PIECE GINNING PLATE

CROSS-REFERENCE TO RELATED APPLICATIONS

This application claims the benefit of U.S. Provisional Application No. 62/409,422, filed on Oct. 18, 2016. The disclosure of the above application is incorporated herein by reference in its entirety.

FIELD

The present teachings relate to cotton crop analytics and research, and more particularly, to a cotton gin designed and operated for crop analytics research, wherein the cotton gin is designed and operable to gin small test samples of cotton harvested from small research test plots efficiently with high purity.

BACKGROUND

The statements in this section merely provide background information related to the present disclosure and may not constitute prior art.

To research and develop various strains, hybrids, or genotypes of cotton, seed producers, plant, grow, and analyze many different varieties of seed. Typically for such research, a single field is subdivided into multiple research, or test plots, each containing plants with distinct germplasm-treatment combinations. Each test plot typically comprises one or more rows of plants comprising five to fifteen cotton plants in each row. Once the plants have matured to desired stage, the cotton (i.e., cotton bolls comprising lint and seed) is harvested and the lint is separated from the seed and other debris, whereafter lint and/or seed can be analyzed to determine such things as lint percent, gin turnout, staple length, etc. Because research test plots, and the cotton sample size collected therefrom, are relatively small it is very important that the lint be separated from the seed efficiently (i.e., the majority or nearly all of the lint be separated from the seed) and with a high level of purity (i.e., the lint collected is free of seed and debris).

Presently, many known seed producers utilize commercial cotton gins, or versions thereof, to separate the lint from the seed. Commercial gins are designed and operated to gin very large volumes of cotton harvested from field that comprise acres and acres of cotton. In such commercial operations, it is not important, desired or necessary to separate the lint from the seed with the efficiently and purity needed and desired for the small research samples that are collected from the small research test plots. Therefore, commercial cotton gins are designed and constructed to gin (i.e., separate the cotton lint from the cotton seed) mass amounts of cotton as quickly as possible. Known commercial cotton gins comprise one or more large head unit(s) into which very large volumes of harvest cotton (e.g., hundreds of pounds) are continuously placed, whereafter the head unit(s) quickly and roughly (i.e., with a low level of efficiency) separate the lint from the seed. Known commercial cotton gin head units generally comprise a plurality of separate, independently fabricated, ribs that are installed side-by-side within a housing of the respective head unit. The ribs are fabricated and shaped such that when placed side-by-side blade gaps are defined between ribs. The head units additionally generally comprise a plurality of circular blades that are mounted below or beneath the ribs such that a portion of each blade extends through a respective one of the blade gaps. The blades are rotated to pull the lint from the seed of the cotton bolls placed in the respective head unit. Particularly, in theory, the blades pull the lint through the gaps and deposit it in one or more cotton collection bin, and the separated seed remains on top of the ribs and slides off the angled face of the ribs into one or more seed collection bin.

However, the dimensions and tolerance of the blade gaps are typically very irregular, imprecise and inconsistent from gap-to-gap. Particularly, the gaps defined by the plurality of ribs typically have shapes and dimensions such that tolerance in space between the sides of the blades and the sides of the respective gap is typically very irregular, imprecise and inconsistent within each respective gap and from gap-to-gap. These irregularities, imprecisions and inconsistencies result in very inefficient impure separation of the lint from the seed. That is, the irregularities, imprecisions and inconsistencies in the gaps formed between and defined by the ribs allow seed and other debris to be pulled through gaps resulting in inefficient and impure lint collection. Additionally, over time, these ribs tend to warp and rust, leading to further poor performance.

SUMMARY

The present disclosure generally provides a cotton gin designed and operated for crop analytics research. Particularly, the cotton gin of the present disclosure is designed and operable to gin (i.e., separate the lint from seed) relatively small test samples of cotton harvested from small research test plots efficiently and produce lint samples with very high purity. The gin includes a head unit into which test samples (e.g., samples comprising from about 1 lb. to about 20 lbs.) are placed and wherein the respective samples are ginned. In various embodiments, the head unit includes a single-piece gin plate designed and fabricated with specific dimensions and features that improve ginning efficiency, providing cleaner, purer cotton lint samples. Particularly, the gin plate comprises a body and a plurality of blade slots extending through the body. The blade slots are formed (e.g., machined) within the body very accurately, precisely and with very low tolerances.

For example, in various embodiments, the present disclosure provides a ginning plate for a crop analytics research cotton gin, wherein the ginning plate comprises a single piece body fabricated from a single block of material. The body includes a front face, a back face, a top end, a bottom end, and opposing sides. The ginning plate additionally comprises a plurality of blade slots extending through the body. Each blade slot comprises an elongated midsection, a mouth disposed at a top of the midsection, and a tail disposed at a bottom of the midsection. The midsection has a first width throughout its length, the mouth has a second width that is greater than the first width, and the tail has a third width that is less than the first width.

This summary is provided merely for purposes of summarizing some example embodiments of the present disclosure so as to provide a basic understanding of some aspects of the teachings herein. Other embodiments, aspects, and advantages will become apparent from the following detailed description taken in conjunction with the accompanying drawings which illustrate, by way of example, the principles of the described embodiments. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

Corresponding reference numerals indicate corresponding parts throughout the several views of drawings.

DETAILED DESCRIPTION

Figure 1:
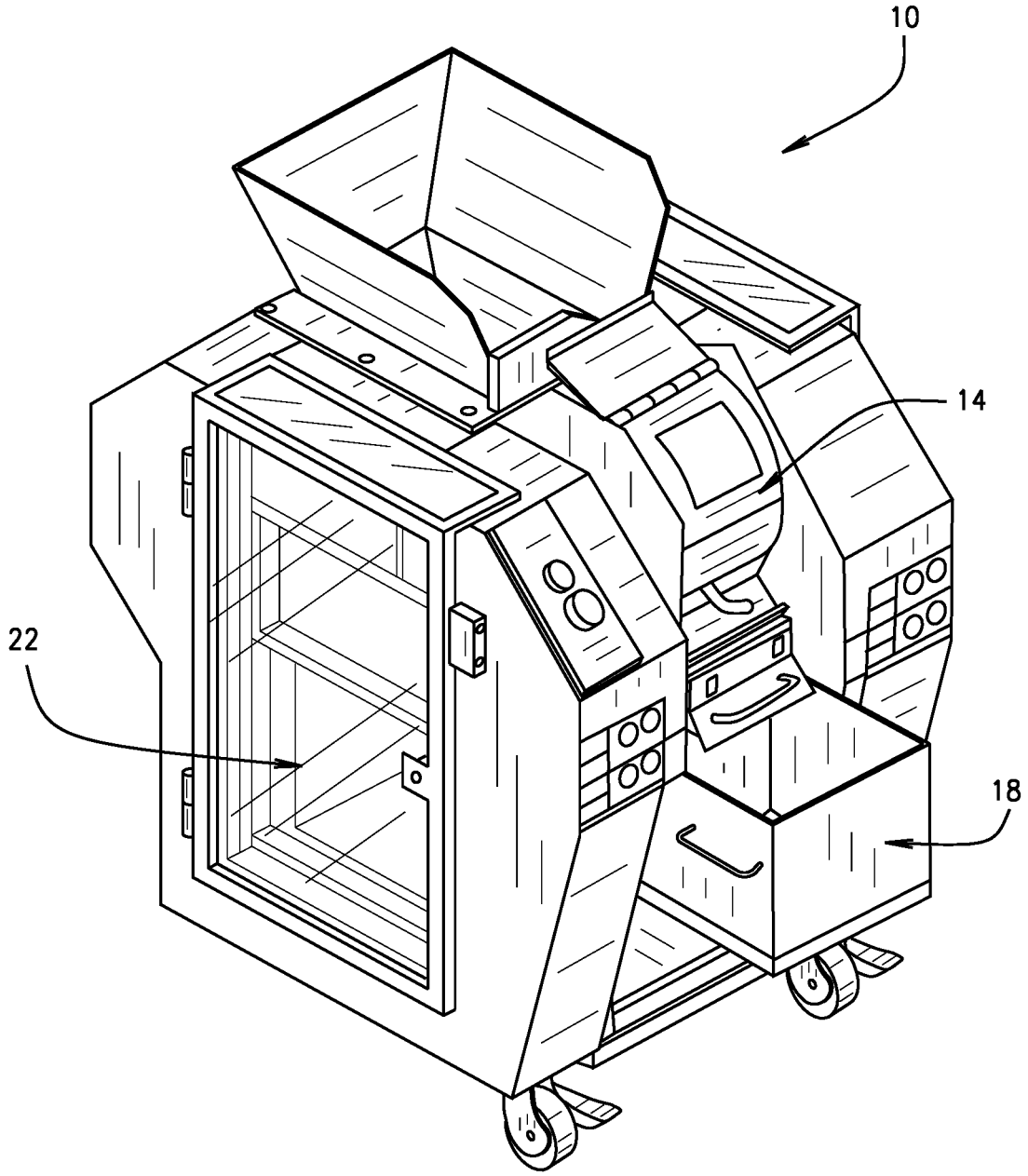
FIG. 1 is an isometric view of a crop analytics research cotton gin comprising a ginning plate, in accordance with various embodiments of the present disclosure.

The following description is merely exemplary in nature and is in no way intended to limit the present teachings, application, or uses. Throughout this specification, like reference numerals will be used to refer to like elements. Additionally, the embodiments disclosed below are not intended to be exhaustive or to limit the invention to the precise forms disclosed in the following detailed description. Rather, the embodiments are chosen and described so that others skilled in the art can utilize their teachings. As well, it should be understood that the drawings are intended to illustrate and plainly disclose presently envisioned embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims.

Unless otherwise defined, all technical and scientific terms used herein have the same meaning as commonly understood by one of ordinary skill in the art to which this disclosure belongs. The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps can be employed.

When an element, object, device, apparatus, component, region or section, etc., is referred to as being "on," "engaged to or with," "connected to or with," or "coupled to or with" another element, object, device, apparatus, component, region or section, etc., it can be directly on, engaged, connected or coupled to or with the other element, object, device, apparatus, component, region or section, etc., or intervening elements, objects, devices, apparatuses, components, regions or sections, etc., can be present. In contrast, when an element, object, device, apparatus, component, region or section, etc., is referred to as being "directly on," "directly engaged to," "directly connected to," or "directly coupled to" another element, object, device, apparatus, component, region or section, etc., there may be no intervening elements, objects, devices, apparatuses, components, regions or sections, etc., present. Other words used to describe the relationship between elements, objects, devices, apparatuses, components, regions or sections, etc., should be interpreted in a like fashion (e.g., "between" versus "directly between," "adjacent" versus "directly adjacent," etc.).

As used herein, the term "and/or" includes any and all combinations of one or more of the associated listed items. For example, A and/or B includes A alone, or B alone, or both A and B.

Although the terms first, second, third, etc. can be used herein to describe various elements, objects, devices, apparatuses, components, regions or sections, etc., these elements, objects, devices, apparatuses, components, regions or sections, etc., should not be limited by these terms. These terms may be used only to distinguish one element, object, device, apparatus, component, region or section, etc., from another element, object, device, apparatus, component, region or section, etc., and do not necessarily imply a sequence or order unless clearly indicated by the context.

Moreover, it will be understood that various directions such as "upper", "lower", "bottom", "top", "left", "right", "first", "second" and so forth are made only with respect to explanation in conjunction with the drawings, and that components may be oriented differently, for instance, during transportation and manufacturing as well as operation.

Because many varying and different embodiments may be made within the scope of the concept(s) herein taught, and because many modifications may be made in the embodiments described herein, it is to be understood that the details herein are to be interpreted as illustrative and non-limiting.

As used herein, a test plot will be understood to mean a single field, or one of a plurality plots within a research field that has been subdivided into a plurality of plots. Each test plot typically comprises one or more rows of plants comprising 5-15 plants in each row, wherein the plants are subject to various crop breeding and analytics research procedures and tests for developing various strains, hybrids, genotypes, etc., of plants. For example, test plots in a growing area can receive certain treatments (e.g., chemical applications to the plants and/or growing environment), and/or can comprise plants of certain genetics, and/or combinations thereof. Each test plot within a field is purposely separated from other test plots by a gap, or alleys, where no plants are grown. The gaps or alleys maintain the identity of the plant material within each respective test plot. Hence, there are typically many alleys in a research field, often comprising 10-30 feet of space with no plants.

Referring to FIG. 1, in various embodiments the present disclosure provides a crop analytics research cotton gin 10 for use by seed producers to research and develop various strains, hybrids, and genotypes of cotton seed. Particularly, the gin 10 is designed, structured and operable to gin cotton (i.e., separate the cotton lint from the cotton seed and other debris) harvested from research test plots (e.g., plots comprising one or more rows of plants comprising from about five to about fifteen cotton plants in each row) with a high rate of efficiency resulting in the ginned lint having a high level of purity (i.e., the collected lint that is substantially free of seed and debris). Because research test plots, and the cotton sample size collected therefrom, are relatively small compared to a commercial cotton production field, it is important that the lint be separated from the seed efficiently and with a high level of purity.

The gin 10 generally comprises a head unit 14 into which the harvested cotton bolls are placed, a lint collection bin 18 disposed beneath the head unit 14, and a seed and debris collection bin 22 disposed adjacent a bottom end of the head unit 14. Generally, in operation, cotton harvested from research and test plots is placed or fed into the head unit 14, where the head unit 14 is structured and operable to gin the cotton (as described below) with a high level of efficiency such that nearly all, if not all, the lint is separated from the seed and is very pure, or clean. The ginned lint is deposited into the lint collection bin 18 and the ginned seed and debris is deposited into the seed and debris collection bin 22.

Figure 2:
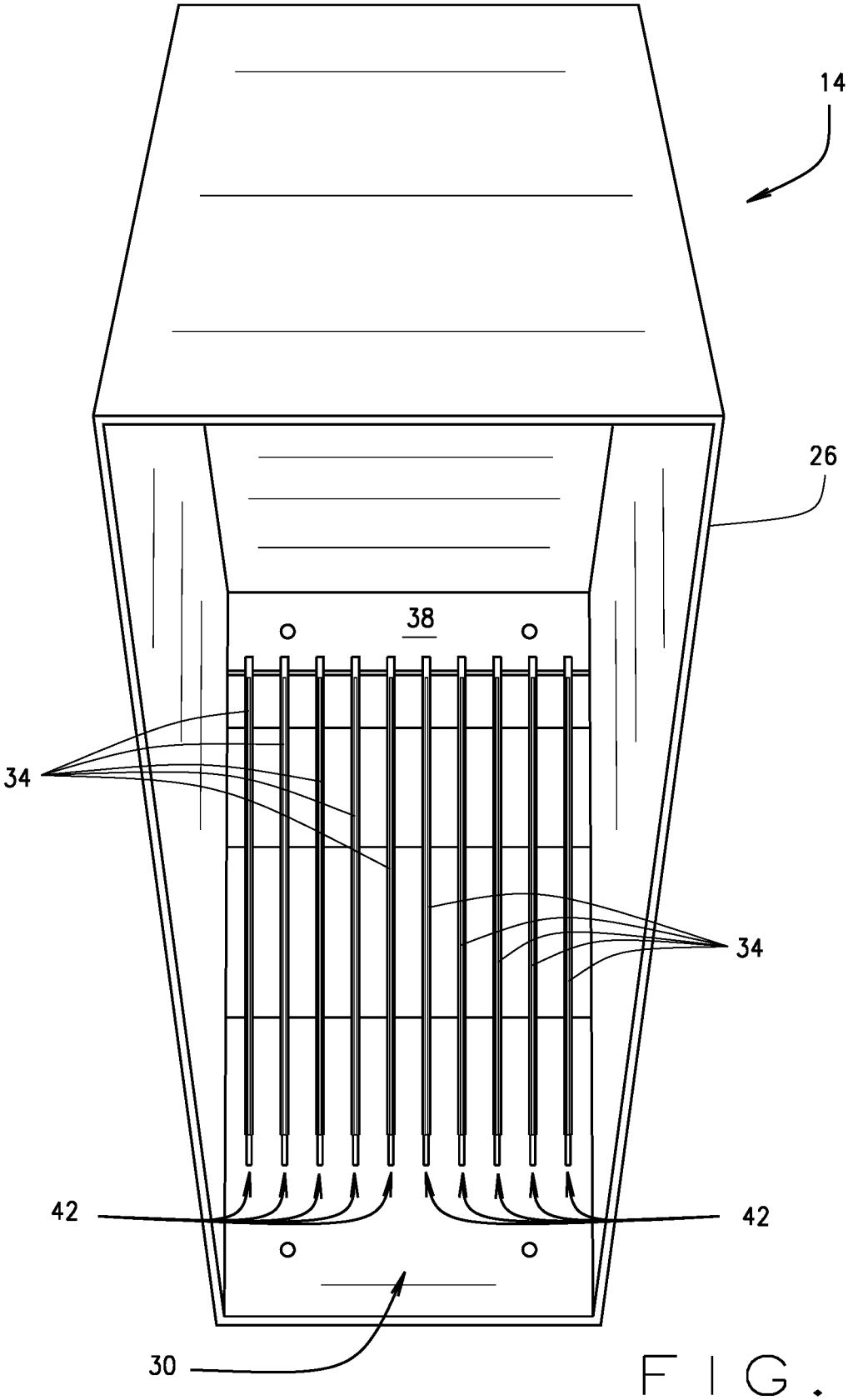
FIG. 2 is a perspective view of a head unit of the crop analytics research cotton gin shown in FIG. 1, the head unit comprising the ginning plate, in accordance with various embodiments of the present disclosure.

Referring now to FIG. 2, in various embodiments, the head unit 14 comprises a housing 26, a ginning plate 30 disposed in a bottom of the housing 26, a plurality of ginning blades 34 rotationally disposed under, or beneath, the ginning plate 30, and at least one motor (not shown) operatively coupled to one or more of the ginning blades 34 and structured and operable to rotate, or spin, the ginning blades 34.

Figure 3:
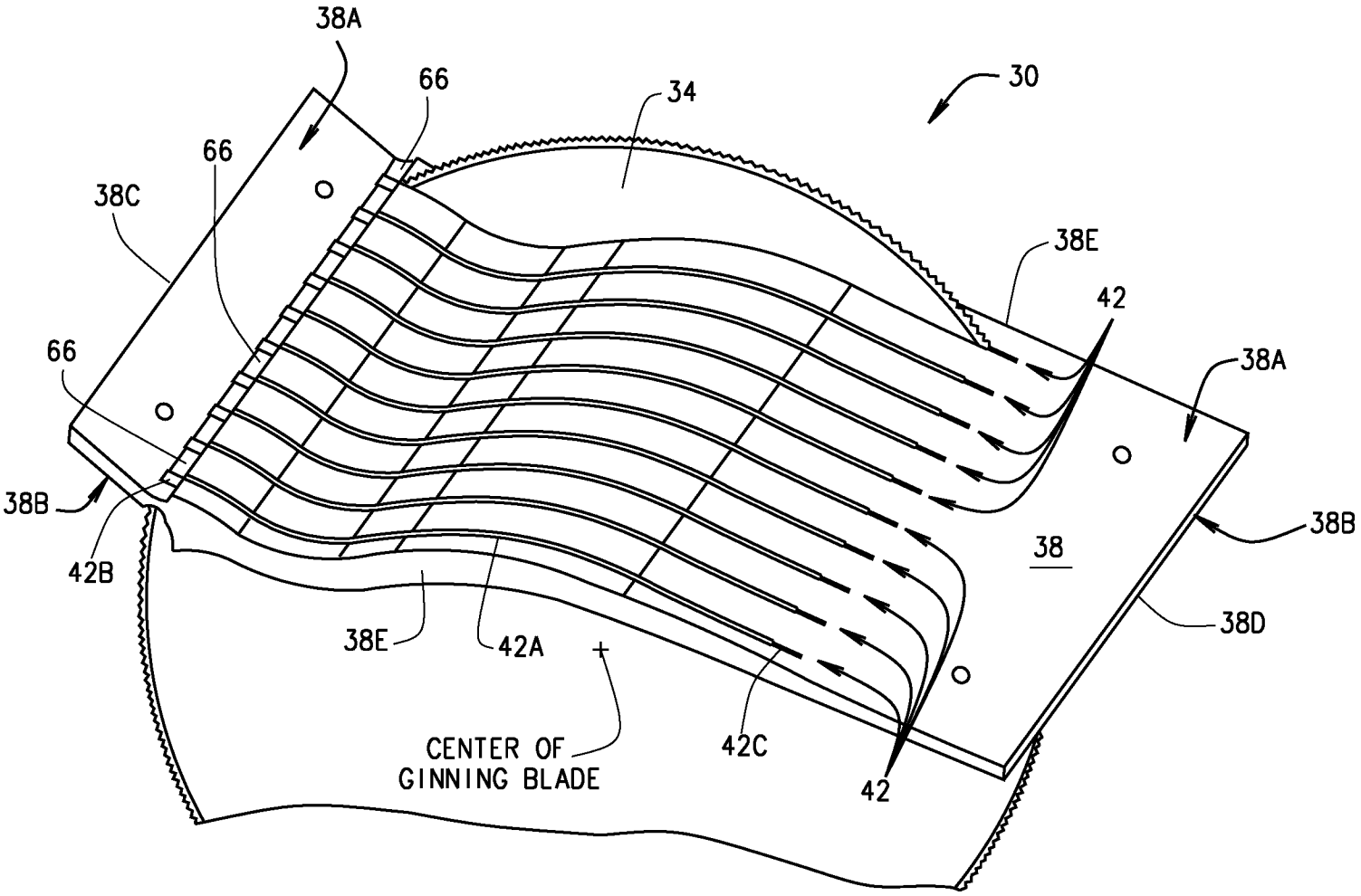
FIG. 3 is an isometric view of the ginning plate, shown in FIG. 2, in accordance with various embodiments of the present disclosure.
Figure 4:
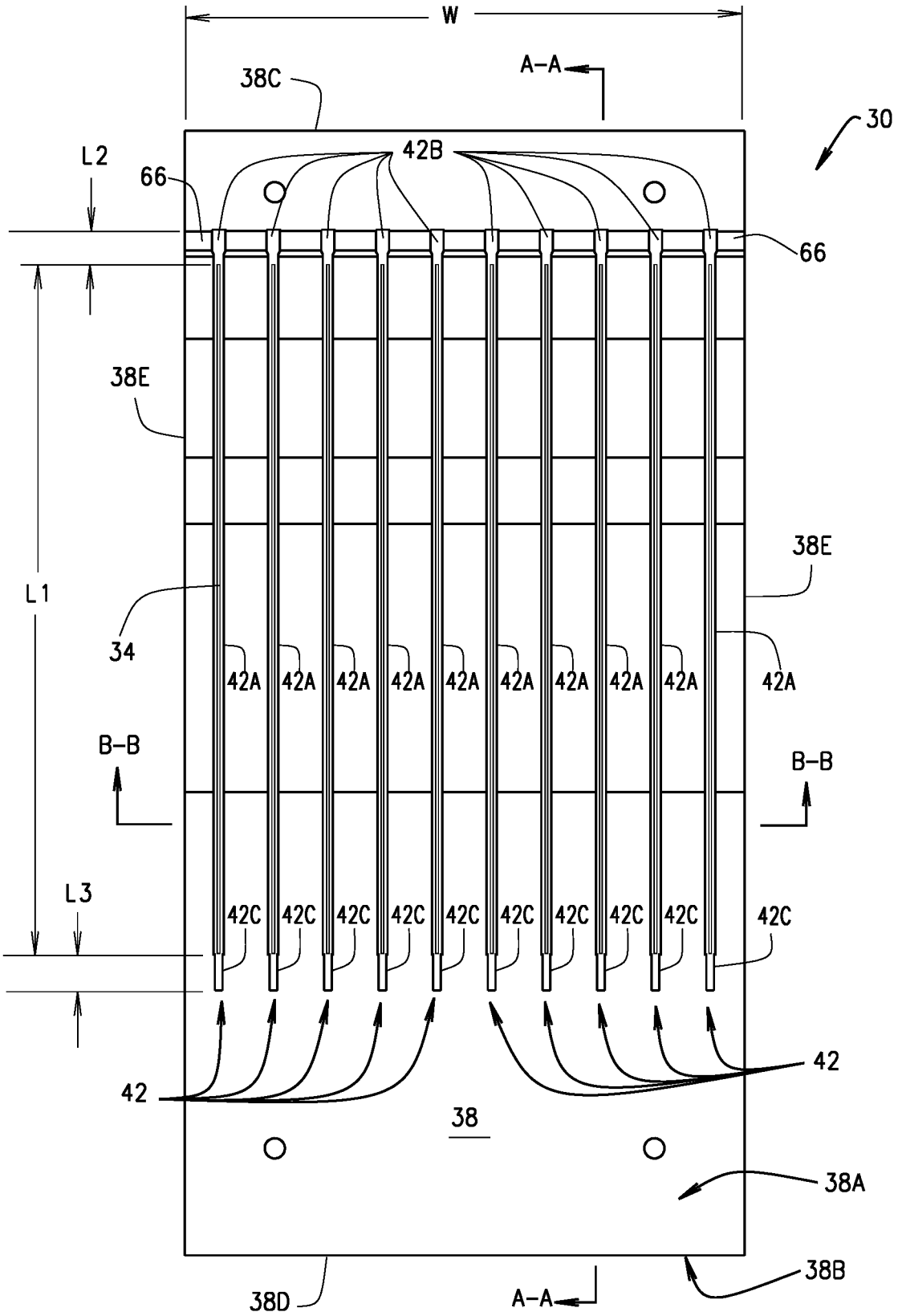
FIG. 4 is top view of the ginning plate, shown in FIGS. 2 and 3, in accordance with various embodiments of the present disclosure.

Referring now to FIGS. 2, 3 and 4, in various embodiments, the ginning plate 30 comprises a body 38 and a plurality of blade slots 42 formed within and extending through the body 38. The body 38 can be comprised of one or more pieces or panels. For example, in various embodiments the body 38 is single piece body 38 comprised of a single panel. In various instances of such embodiments, the ginning plate 30 can be fabricated from a single block of material. Alternatively, the body 38 can be comprised of two or more panels. However, for simplicity and clarity, the body 38 will be described herein as a single piece body (i.e., comprised of a single panel). The blade slots 42 are formed within the body 38 substantially parallel and equally spaced with each other.

The ginning plate body 38 (or each panel thereof) can be fabricated from a single block of material. The single block can be any desirable material that can be fabricated, manufactured, formed or constructed (e.g., milled, cast, cut, moulded, etc.) to very exact/precise measurements so that all the features of the plate 30 described herein (e.g., the length and width of the plate 30, the curvatures of the various surfaces/faces of the plate, the shape of the blade slots 42, the width of the blade slots 42, the length of the blade slots 42, etc.) can be fabricated, manufactured, formed or constructed with very low tolerances, and maintain the tolerances throughout the life of the plate 30. For example, the ginning plate 30 can be fabricated from any suitable metal, polycarbonate, fiberglass, carbon fiber, 3D printing technology, etc., that can be fabricated, manufactured, formed or constructed to very exact/precise measurements with very low tolerances. For example, in various embodiments, the ginning plate body 38 (or each panel thereof) can be milled from a single block of hardened steel (e.g., a medium or high carbon steel that has been heat treated, quenched and tempered). Particularly, in various embodiments, the ginning plate body 38 is milled from pre-hardened steel, that is, a block of steel that is hardened prior to milling the blade slots 42 and the various contours and features the various surfaces of the body 38. Utilizing pre-hardened steel prevents warping of the body 38, and maintains the low tolerances of the blade slots 42 and the various contours and features the various surfaces of the body 38 (described below) throughout the life of the ginning plate 30. The ginning plate 30, i.e., the ginning plate body 38, includes a front face 38A, a back face 38B, a top end 38C, a bottom end 38D, and opposing sides 38E.

Figure 5:
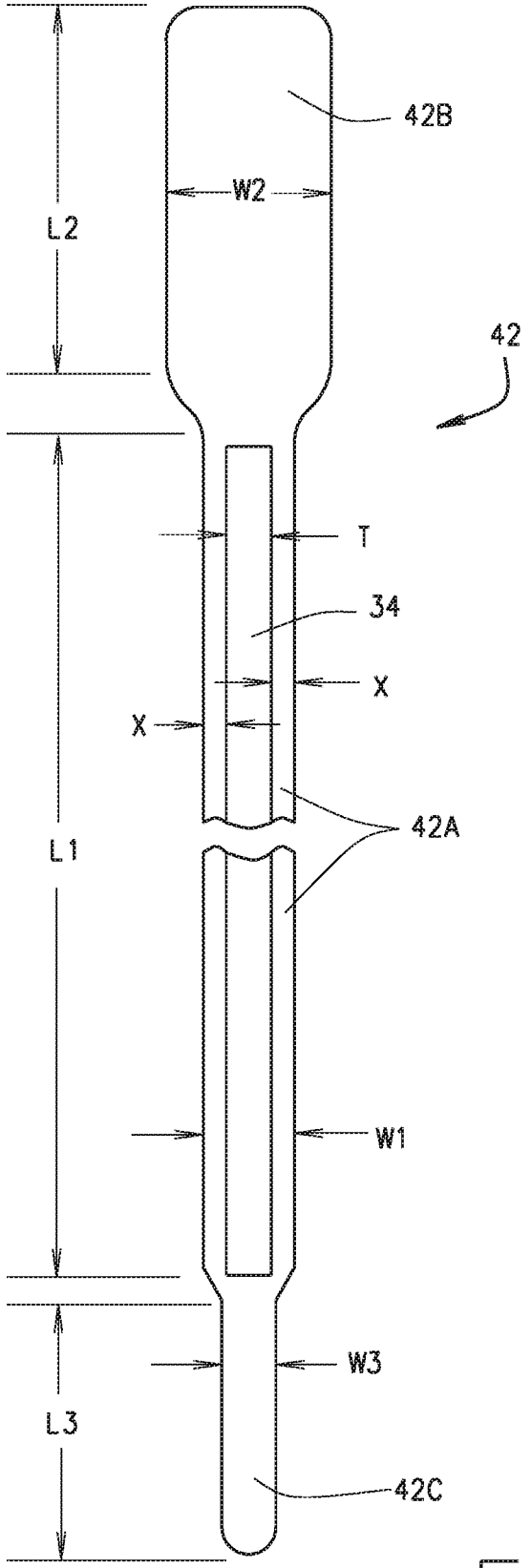
FIG. 5 is a schematic of one of a plurality of blade slots formed in the ginning plate, shown in FIGS. 2, 3 and 4, in accordance with various embodiments of the present disclosure.

Referring now to FIGS. 3, 4 and 5, at least a portion of each ginning blade 34 extends through a respective one of the blade slot 42 such that each blade protrudes above the front face 38A of ginning plate 30 (exemplarily illustrated in FIG. 3) and rotates about a center of the ginning blade 34. Hence, the front face 38A is the face of the ginning plate 34 past which the periphery of ginning blades 34 extend. Each blade slot 42 comprises an elongated midsection 42A, a mouth portion 42B (referred to herein as the mouth 42B) disposed at a top end of the midsection 42A and forming the top end of the blade slot 42, and a tail portion 42C (referred to herein as the tail 42C) disposed at a bottom end of the midsection 42A and forming the bottom end of the blade slot 42. The midsection 42A of each blade slot 42 is formed within the body 38 to have a precise and consistent width W1 throughout the length L1 of the midsection 42A (also referred to herein as the first width W1). Particularly, each blade slot 42 is formed within the body 38 (e.g., milled within the body 38) to have a precise and consistent width W1 having a very low tolerance (i.e., very small variation in the width W1) throughout the length L1 of the midsection 42A. For example, in various embodiments, the width W1 of the midsection 42A of each blade slot 42 at the front face 38A can be between 0.090 and 0.115 inches (e.g., 0.104 inches) with a tolerance of +0.005/−.010 inches throughout the length L1 of each respective blade slot midsection 42A. Moreover, the width W1 of the midsections 42A of the blade slots 42 is determined based on the thickness T of the ginning blades 34. For example, in various embodiments, the thickness T of each ginning blade 38 can be between 0.035 and 0.040 inches (e.g., 0.038 inches) and a distance X between the sides of each ginning blade 38 and the sides of the respective midsection 42A at the top face 38A of the body 38 can be between 0.015 and 0.040 inches. For example, in various instances, the thickness T of each ginning blade 38 can be 0.038 inches, and the width W1 of each blade slot 42 midsection 42A can be 0.104 inches, such that the distance X between the sides of each ginning blade 38 and the sides of the respective blade slot midsection 42A at the top face 38A of the body 38 is 0.033 inches. The precision and low tolerances maintained through the length L1 of the midsection 42A of each blade slot 42 helps prevent seeds and debris from falling through the midsections 42A into the lint collection bin 18, thereby preventing contamination of the lint collected in the lint collection bin 18, i.e., maintaining the purity of the collected lint.

The mouth 42B of each blade slot 42 is elongated and formed within the body 38 to have a precise and consistent width W2 throughout a length L2 of the elongated mouth 42B (also referred to herein as the second width W2). It should be noted that the length L2 comprises the main body portion of the mouth 42B (see FIG. 5) that does not include a neck or transition portion connecting the main body portion of the mouth 42B to the midsection 42A. Particularly, each blade slot 42 is formed within the body 38 (e.g., milled within the body 38) to have a precise and consistent width W2 having a very low tolerance (i.e., very small variation in the width W2) throughout the length L2 of the mouth 42B. The width of the mouth 42B (along the length L2 of the main portion) of each blade slot 42 is wider than (e.g., greater than) the width W1 of the midsection 42A of each blade slot 42. For example, in various embodiments, the width W2 of the mouth 42B (along the length L2 of the main portion) of each blade slot 42 can be between 0.055 and 0.062 inches wider than the width W1 of the midsection 42A of each blade slot 42. For example, in various embodiments, the width W2 of each mouth 42B (along the length L2 of the main portion) can be between 0.150 and 0.170 inches (e.g., 0.160 inches) with a tolerance of +0.005/−.010 inches throughout the length L2 of each respective blade slot mouth 42B. The precision and low tolerances maintained through the length L2 of the mouth 42B of each blade slot 42 allows the ginning blades 34 to easily pull the cotton lint through the mouths 42B without jamming.

The tail 42C of each blade slot 42 is elongated and formed within the body 38 to have a precise and consistent width W3 throughout the length L3 of the elongated tail 42C (also referred to herein as the third width W3). It should be noted that the length L3 comprises the main body portion of the tail 42C (see FIG. 5) that does not include a shoulder or transition portion connecting the main body portion of the tail 42C to the midsection 42A. Particularly, each blade slot 42 is formed within the body 38 (e.g., milled within the body 38) to have a precise and consistent width W3 having a very low tolerance (i.e., very small variation in the width W3) throughout the length L3 of the tail mouth 42C. The width of the tail 42C (along the length L3 of the main portion) of each blade slot 42 is narrower than (or smaller than or less than) the width W1 of the midsection 42A of each blade slot 42. For example, in various embodiments, the width W3 (along the length L3 of the main portion) of the tail 42C of each blade slot 42 can be between 0.015 and 0.025 inches narrower than the width W1 of the midsection 42A of each blade slot 42. For example, in various embodiments, the width W3 (along the length L3 of the main portion) of each tail 42C can be between 0.070 and 0.090 inches (e.g., 0.080 inches) with a tolerance of +0.005/−.010 inches throughout the length L3 of each respective blade slot tail 42C. The precision and low tolerances maintained through the length L3 of the tail 42C of each blade slot 42 prevent seeds and debris from falling through the blade slot tails 42C into the lint collection bin 18, thereby preventing contamination of the lint collected in the lint collection bin 18, i.e., maintaining the purity of the collected lint.

Figure 6:
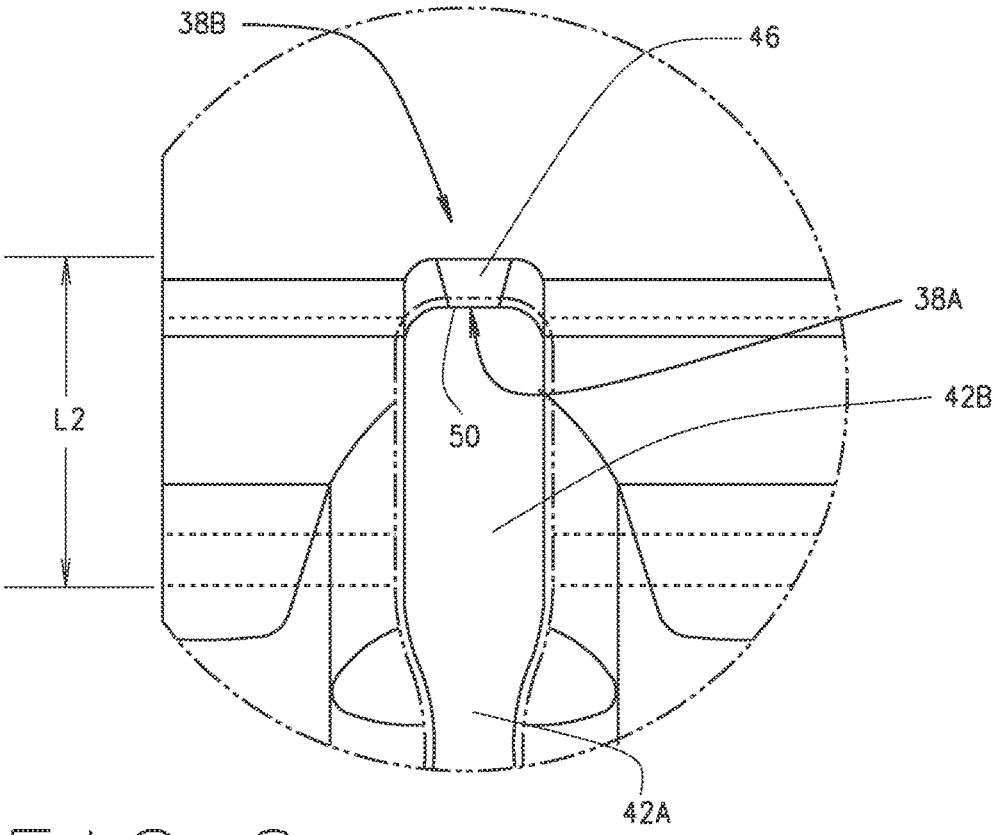
FIG. 6 is a rear view of a mouth of one of the plurality of blade slots, i.e., a view from a mouth of one of the plurality of blade slots shown from a back face of the one piece ginning plate shown in FIGS. 2, 3 and 4, in accordance with various embodiments of the present disclosure.
Figure 7:
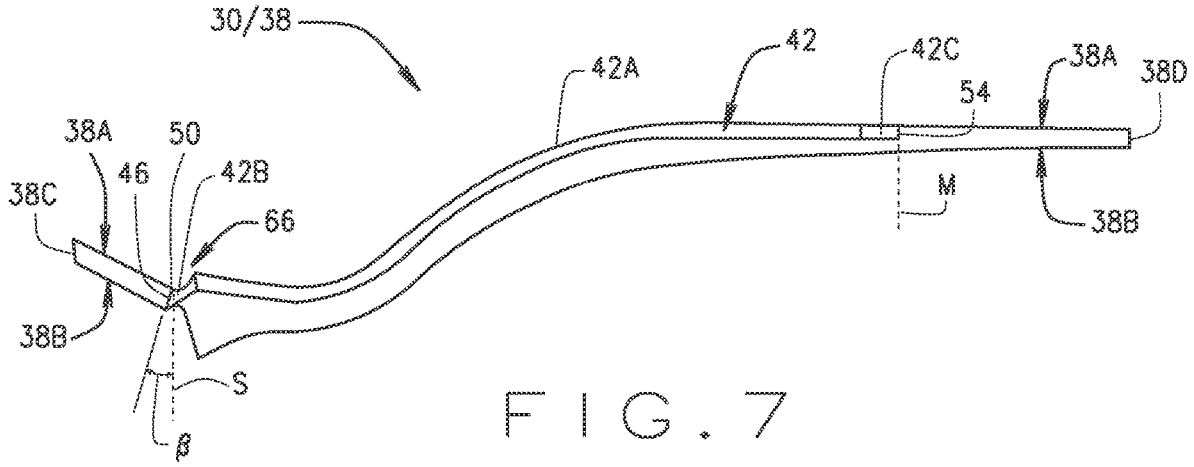
FIG. 7 is a cross-sectional view of the ginning plate shown in FIGS. 2, 3 and 4 along line A-A (FIG. 4) through the length of one of the plurality of blade slots, in accordance with various embodiments of the present disclosure.

Referring now to FIGS. 6 and 7, in various embodiments, a distal wall 46 of the mouth 42B of each blade slot 42 is angled or chamfered or beveled at an angle β with respect to a square line S as the distal wall 46 extends through the body 38 from the front face 38A to the back face 38B. The angled distal wall 46 of the mouth 42B also defines the distal end wall of the first distal end of the respective slot 42. The square line S is an imaginary line that extends from a front face terminus edge 50 of the blade slots 42 through the blade slots/body 42/38 such that the square line S is substantially parallel to a line M that extends along and from a proximal wall 54. Particularly, the distal wall 46 defines a top end of each blade slot 42 and is angled outward at the angle β, away from the midsection 42A of each blade slot 42, as the distal wall 46 extends from the front face 38A of the body 38 to the back face 38B of the body 38. The angle β can be any desired angle. For example, in various embodiments that angle β can be 5° to 40°, e.g., 20°. The angled distal wall 46 of each blade slot mouth 42B allows the ginning blades 34 to easily pull the cotton lint through the mouths 42B without jamming.

Figure 8:
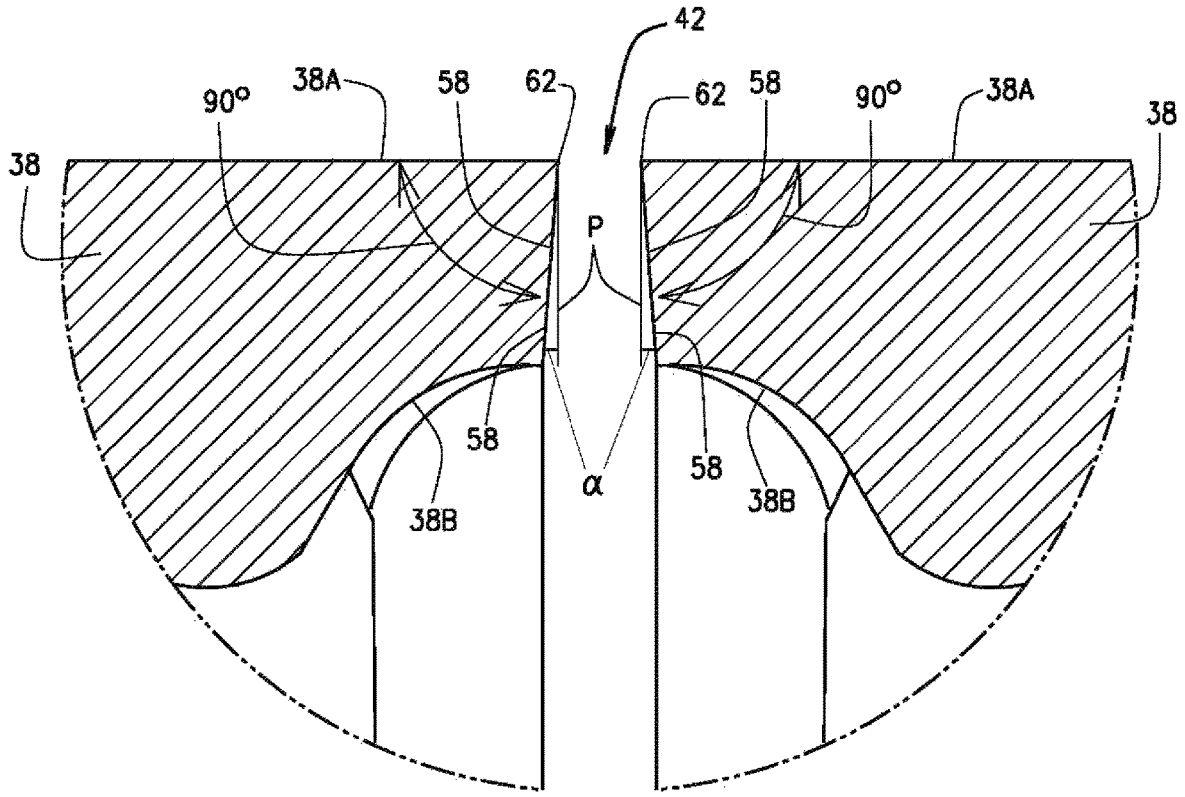
FIG. 8 is a cross-sectional view of the ginning plate shown in FIGS. 2, 3 and 4 along line B-B (FIG. 4) through the midsection of one of the plurality of blade slots, in accordance with various embodiments of the present disclosure.
Figure 9:
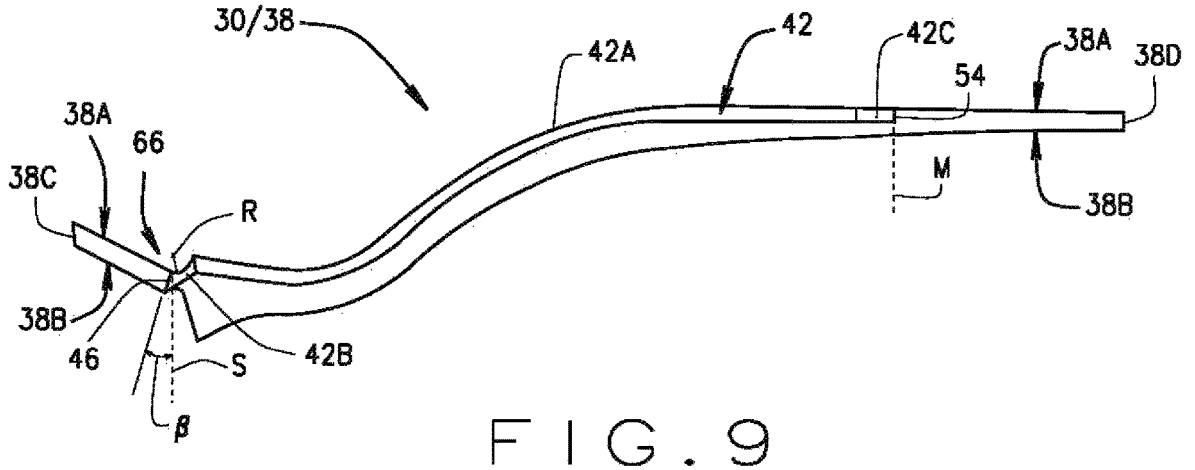
FIG. 9 is a side view of the ginning plate shown in FIGS. 2, 3 and 4 illustrating a seed roll channel formed in a front face of the ginning plate, in accordance with various embodiments of the present disclosure.

Referring now to FIG. 8, in various embodiments, each of the opposing sidewalls 58 of each blade slot 42 is angled or chamfered or beveled at an angle α with respect to a respective square line P as the sidewalls 58 extend through the body 38 from the front face 38A to the back face 38B. The square lines P are imaginary lines that extends from a front face side edges 62 of the blade slots 42 through the blade slot/body 42/38 such that the square lines P are substantially perpendicular to (i.e., square with or at 90° angles with) the top face 38A of the body 38. Particularly, the sidewalls 58 are angled outward at the angle α, away from a center of each blade slot 42, as the sidewalls 58 extend from the front face 38A of the body 38 to the back face 38B of the body 38. That is, the sidewalls 58 are angled away from the square lines P at the angle α such that each blade slot 42 has a narrower width at the front face 38A of the body 38 than at the back face 38B of the body 38. The angle α can be any desired angle. For example, in various embodiments that angle α can be 1° to 20°, e.g., 6°. The angled sidewalls 58 of each blade slot 42 allow the ginning blades 34 to easily pull the cotton lint into the lint collection bin 18 without jamming.

Referring now to FIGS. 3, 4, 7 and 9, the front face 38A of the ginning plate 30, i.e., of the ginning plate body 38, has a multi-curved contour or profile, as exemplarily illustrated in FIGS. 3, 4, 7 and 9. In various embodiments, the contour of the front face comprises a seed roll channel, or groove, or furrow or gutter 66 that extends laterally across the ginning plate 30 such that the mouth 42B of each blade slot 42 is disposed within the seed roll channel 66. The seed roll channel 66 is structured and operable to collect cotton as the cotton is being ginned by the ginning blades 34 and generate or develop a roll of cotton (referred to as a seed roll) that is rolled or rotated within the seed roll channel 66 by the ginning blades 34. As the roll of cotton is rolled within the seed roll channel 66 by the ginning blades 34, the ginning blades separate the cotton lint from the cotton seed and debris, and pull the lint through the blade slot mouths 42B and deposit the separated lint into the lint collection bin 18.

The ginning plate 30 is disposed within the head unit 14 such that it is angled or sloped having the top end 38C of the body 38 higher than the bottom end 38D. Therefore, the seed and debris that is separated from the lint slides or rolls along the angled or sloped front face 38A between the ginning blades and falls off the bottom end 38E of the plate body 38 into the seed and debris collection bin.

The seed roll channel 66 is formed within the body 38 (e.g., milled within the body 38) to have a precise and consistent radius R having a very low tolerance (i.e., very small variation in the radius R) throughout the length W of the seed roll channel 66, i.e., throughout the width W of the ginning plate 30. The radius R of the seed roll channel 66 can be any desired length that is suitable to efficiently generate/develop the seed roll, whereby the ginning blades 34 can efficiently separate the cotton lint from the cotton seed/debris. For example, in various embodiments the radius R of the seed roll channel 66 can be between 0.010 inches and 0.030 inches (e.g., 0.020 inches) with a tolerance of +0.005/−.010. The precision and low tolerances maintained through the length W of the seed roll channel 66 allows the ginning blades 34 to easily generate/develop the seed roll and pull the cotton lint from the seed rolls through the mouths 42B without jamming.

Referring now to FIGS. 1 through 9, in various embodiments, at least one of the top face 38A, the surfaces the sidewalls 58 (inclusive of the sidewalls of the mouth 42B and the tail 42C), the surfaces of distal wall 46 of the mouths 42B, and the proximal wall 54 of the tails 42C of the blade slots 42 can be highly polished to improve the operation and efficiency of the cotton ginning utilizing the ginning plate 30. Additionally, in various embodiments, at least one of the top face 38A, the surfaces the sidewalls 58 (inclusive of the sidewalls of the mouth 42B and the tail 42C), the surfaces of distal wall 46 of the mouths 42B, and the proximal wall 54 of the tails 42C of the blade slots 42 can be coated or treated with a lubricant to improve the operation and efficiency of the cotton ginning utilizing the ginning plate 30. Furthermore, in various embodiments, at least one of the top face 38A, the surfaces the sidewalls 58 (inclusive of the sidewalls of the mouth 42B and the tail 42C), the surfaces of distal wall 46 of the mouths 42B, and the proximal wall 54 of the tails 42C of the blade slots 42 can be coated or treated with an anti-friction coating or treatment to improve the operation and efficiency of the cotton ginning utilizing the ginning plate 30. Still further, in various embodiments, the entire ginning plate 30 (i.e., all surfaces of the ginning plate 30) can be coated or treated with a corrosion-resistant coating or treatment to improve the lifetime, and hence, the operation and efficiency of the cotton ginning utilizing the ginning plate 30.

Uses of the ginning plate 30 described herein are not limited to certain upstream or downstream activities related to cotton cultivation, research, or processing. It is envisioned that one could gin cotton using at least one structure, feature, and/or function of a ginning plate 30 to create exceptionally pure samples of cotton fiber, and/or collect seeds from a sample of cotton, as part of a commercial plant breeding pipeline that creates elite cotton varieties. That is, any method of phenotyping, genotyping, or otherwise analyzing the tissues of a cotton plant could be used before, during, or after a sample of cotton is ginned using the ginning plate 30 described herein. For example, a user can analyze a sample of cotton using the teachings described in PCT Application PCT/US2015/052133, titled High Throughput Methods of Analyzing Seed Cotton Using X-Ray Imaging, filed Sep. 25, 2015, and corresponding U.S. Provisional Application 62/055,861, filed Sep. 26, 2014, the disclosure of each being incorporated by reference herein in their entirety. Similarly, a user can analyze a sample of cotton using the teachings described in PCT Application PCT/US2016046280, titled Automated Plant Product Sampler, filed Aug. 10, 2016 and corresponding U.S. Provisional Application 62/210,237, filed Aug. 26, 2015, the disclosure of each being incorporated by reference herein in their entirety. A user can collect a sample of cotton and analyze the sample using these, and any other methods disclosed in the art, to determine a characteristic of the sample, and then base a decision about whether or not to gin the sample with a precision ginning plate 30 on the results of at least one of those analyses.

Furthermore, the methods of using the ginning plate 30 that are described herein are not limited to any specific brand, type, or variation of ginning machine known in the art. Any ginning machine that can use a gin plate 30 to separate seed from cotton fiber, as described herein, would fall within the scope of this invention. For example, although the descriptions herein focus on the use of relatively small, research ginning machines that are typically operated indoors, one of skill in the art will immediately recognize that the embodiments described herein could also be used on a mobile and/or mechanized cotton picker/harvester in the field in order to create cotton samples substantially free of trash and/or seeds. Furthermore, such a system could also include any analytical tool useful for determining one or more traits related to crop performance, e.g., yield, fiber quality, etc. Thus, it is envisioned that one could use the precision ginning plate 30 in conjunction with a cotton harvester/picker to create very pure samples of seeded cotton as the harvester moved through a cotton research testing plot. The cotton fiber and or the seeds/trash ginned from the cotton fiber could in turn be analyzed by onboard devices to determine one or more useful characteristic related to crop performance and the results used to improve selection accuracy in a commercial breeding program. Such a mobile system could be a totally automated 'Smart' system, such as the system described in PCT Application PCT/US2015/045301, titled Apparatus And Methods For In-Field Data Collection And Sampling, filed Aug. 14, 2015, and corresponding U.S. Provisional Application 62/037,968, filed Aug. 15, 2014, the disclosure of each being incorporated by reference herein in their entirety. Particularly, it is envisioned that the systems and method described in PCT Application PCT/US2015/045301 can incorporate the systems and methods described above, and vice-versa, to collect one or more plant product sample(s), gin the one or more plant product sample(s), analyze the sample(s), make a decision about a treatment application at the site or on a plant, and apply a treatment—all from the same platform. Also, that the sample(s) and any information regarding the sample(s), generated by the respective system, could be combined with any data or information collected from an "analytics suite", such as that described in PCT Application PCT/US2015/045301, (e.g., cameras, soil samples, etc., disposed on a mobile platform 14) to assist in this process.

The description herein is merely exemplary in nature and, thus, variations that do not depart from the gist of that which is described are intended to be within the scope of the teachings. Moreover, although the foregoing descriptions and the associated drawings describe example embodiments in the context of certain example combinations of elements and/or functions, it should be appreciated that different combinations of elements and/or functions can be provided by alternative embodiments without departing from the scope of the disclosure. Such variations and alternative combinations of elements and/or functions are not to be regarded as a departure from the spirit and scope of the teachings.

What is claimed is:

1. A ginning plate, said plate comprising:

a body fabricated from a single block of hardened steel having a front face, a back face, a top end, a bottom end, and opposing sides, the front face contoured to provide a seed roll channel extending laterally across the front face; and a plurality of blade slots milled through the body that define a plurality of openings extending through the body from the front face to the back face, the front face being a face of the body past which a periphery of a plurality of ginning blades will extend and protrude and the back face being a face of the body nearer a center of the ginning blades, each of the plurality of blade slot openings comprising an elongated midsection, an elongated mouth disposed at a top of the midsection and defining a first distal end of the blade slot, and an elongated tail disposed at a bottom of the midsection and defining a second distal end of the blade slot opposing the first distal end, wherein at the front face of the body the midsection has a first width having a tolerance of +0.005/−0.010 inches throughout its length, the mouth has a second width having a tolerance of +0.005/−0.010 inches throughout its length, the second width being greater than the first width, and the tail has a third width having a tolerance of +0.005/−0.010 inches throughout its length, the third width being less than the first width, the tail having a length that is shorter than a length of the midsection;

wherein the midsection of each of the plurality of blade slots comprises opposing sidewalls that are angled outward at an angle away from a center of each of the plurality of blade slots as the sidewalls extend from the front face of the body to the back face of the body;

wherein the mouth of each slot comprises an angled distal wall defining a distal end wall of the first distal end of the respective slot, the mouth distal wall angled outward, away from the midsection of the respective slot as the mouth distal wall extends through the body from the front face of the body to the back face of the body.

2. The plate of claim 1, wherein the seed roll channel has a radius of between 0.010 inches and 0.030 inches.

3. The plate of claim 1, wherein the body has at least one of a corrosion resistant coating and an anti-friction coating disposed thereon.

4. A head unit for a cotton gin, said head unit comprising:

a housing;

a plurality of ginning blades rotationally disposed within the housing;

a ginning plate disposed within the housing such that the ginning blades rotationally disposed under the ginning plate, the ginning plate comprising:

a body fabricated from a single block of hardened steel having a front face, a back face, a top end, a bottom end, and opposing sides, the front face contoured to provide a seed roll channel extending laterally across the front face; and a plurality of blade slots milled through the body that define a plurality of openings extending through the body from the front face to the back face and through which the ginning blades extend, the front face being a face of the body past which a periphery of the ginning blades extend and protrude and the back face being a face of the body nearer a center of the ginning blades;

each of the plurality of blade slot openings comprising an elongated midsection, an elongated mouth disposed at a top of the midsection and defining a first distal end of the blade slot, and an elongated tail disposed at a bottom of the midsection and defining a second distal end of the blade slot opposing the first distal end, wherein at the front face of the body the midsection has a first width having a tolerance of +0.005/−0.010 inches throughout its length, the mouth has a second width having a tolerance of +0.005/−0.010 inches throughout its length, the second width being greater than the first width, and the tail has a third width having a tolerance of +0.005/−0.010 inches throughout its length, the third width being less than the first width;

wherein the midsection of each of the plurality of blade slots comprises opposing sidewalls that are angled outward at an angle away from a center of each of the plurality of blade slots as the sidewalls extend from the front face of the body to the back face of the body; and wherein the mouth of each slot comprises an angled distal wall defining a distal end wall of the first distal end top end of the respective slot, the mouth distal wall angled outward, away from the midsection of the respective slot as the mouth distal wall extends through the body from the front face of the body to the back face of the body.

5. The head unit of claim 4, wherein the seed roll channel has a radius of between 0.010 inches and 0.030 inches.

6. The head unit of claim 4, wherein the ginning plate body has at least one of a corrosion resistant coating and an anti-friction coating disposed thereon.

7. A cotton gin, said gin comprising:

a head unit, the head unit comprising:

a housing;

a plurality of ginning blades rotationally disposed within the housing;

a ginning plate disposed within the housing such that the ginning blades rotationally disposed under the ginning plate, the ginning plate comprising:

a body fabricated from a single block of hardened steel having a front face, a back face, a top end, a bottom end, and opposing sides, the front face contoured to provide a seed roll channel extending laterally across the front face; and a plurality of blade slots milled through the body that define a plurality of openings extending through the body from the front face to the back face and through which the ginning blades extend and protrude, the front face being a face of the body past which a periphery of the ginning blades extends and the back face being a face of the body nearer a center of the ginning blades, each of the plurality of blade slot openings comprising an elongated midsection, an elongated mouth disposed at a top of the midsection and defining a first distal end of the blade slot, and an elongated tail disposed at a bottom of the midsection and defining a second distal end of the blade slot opposing the first distal end, wherein at the front face of the body the midsection has a first width having a tolerance of +0.005/−0.010 inches throughout its length, the mouth has a second width having a tolerance of +0.005/−0.010 inches throughout its length, the second width being greater than the first width, and the tail has a third width having a tolerance of +0.005/−0.010 inches throughout its length, the third width being less than the first width;

wherein the midsection of each of the plurality of blade slots comprises opposing sidewalls that are angled outward at an angle away from a center of each of the plurality of blade slots as the sidewalls extend from the front face of the body to the back face of the body;

wherein the mouth of each slot comprises an angled distal wall defining a distal end wall of the first distal end of the respective slot, the mouth distal wall angled outward, away from the midsection of the respective slot as the mouth distal wall extends through the body from the front face of the body to the back face of the body; and.

8. The cotton gin of claim 7, wherein the seed roll channel has a radius of between 0.010 inches and 0.030 inches.

9. The cotton gin of claim 7, wherein the ginning plate body has at least one of a corrosion resistant coating and an anti-friction coating disposed thereon.

10. The cotton gin of claim 9, wherein the cotton gin is located on a mobile platform capable of harvesting cotton.

11. The cotton gin of claim 10, wherein the cotton gin is located on a harvester-combine.

* * * * *